US008523618B2

(12) United States Patent
Ju et al.

(10) Patent No.: US 8,523,618 B2
(45) Date of Patent: Sep. 3, 2013

(54) HIGH FREQUENCY ADAPTER

(75) Inventors: Ted Ju, Keelung (TW); Tien Chih Yu, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 13/371,776

(22) Filed: Feb. 13, 2012

(65) Prior Publication Data

US 2013/0130558 A1 May 23, 2013

(30) Foreign Application Priority Data

Nov. 18, 2011 (CN) ..... 2011 2 0459105

(51) Int. Cl.
*H01R 11/22* (2006.01)

(52) U.S. Cl.
USPC ..... 439/816

(58) Field of Classification Search
USPC ..... 439/816, 141, 500, 862, 660
See application file for complete search history.

(56) References Cited

U.S. PATENT DOCUMENTS 5,538,435 A * 7/1996 Yohn ..... 439/188
5,828,343 A * 10/1998 MacDonald et al. ..... 343/702
5,873,045 A * 2/1999 Lee et al. ..... 455/556.2
6,469,681 B1 * 10/2002 Jones et al. ..... 343/906
6,654,464 B2 * 11/2003 Roussy et al. ..... 379/433.05
6,951,488 B2 * 10/2005 Hsieh ..... 439/660
7,357,665 B1 * 4/2008 Yan ..... 439/500
7,693,484 B2 * 4/2010 Ting et al. ..... 455/41.2
7,803,011 B1 * 9/2010 Mai ..... 439/500
7,833,069 B2 * 11/2010 Wu et al. ..... 439/862
8,016,610 B1 * 9/2011 Lee et al. ..... 439/500
8,180,294 B2 * 5/2012 Ting et al. ..... 455/41.2
2004/0097264 A1 * 5/2004 Bodnar et al. ..... 455/556.1
2008/0081495 A1 * 4/2008 Long et al. ..... 439/141
2009/0047846 A1 * 2/2009 Zhang et al. ..... 439/816
2009/0170378 A1 * 7/2009 Harada ..... 439/701

* cited by examiner

*Primary Examiner* — Alexander Gilman

(74) *Attorney, Agent, or Firm* — Morris Manning & Martin LLP; Tim Tingkang Xia, Esq.

(57) ABSTRACT

A high frequency adapter electrically connecting a docking device to a circuit board. The high frequency adapter includes an insulating body, a high frequency signal terminal conductively connected to the circuit board, and two grounding terminals located at two sides of the high frequency signal terminal and conductively connected to the circuit board. Lateral projections of the high frequency signal terminal and the two grounding terminals are approximately the same and overlapping. Both the high frequency signal terminal and the two grounding terminals are pressed by the docking device.

9 Claims, 10 Drawing Sheets

HIGH FREQUENCY ADAPTER

CROSS-REFERENCE TO RELATED APPLICATIONS

This non-provisional application claims priority under 35 U.S.C. §119(a) on Patent Application No. 201120459105.5 filed in P.R. China on Nov. 18, 2011, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to a high frequency adapter, and more particularly to a high frequency adapter electrically connecting a docking device to a circuit board.

BACKGROUND OF THE INVENTION

Currently, with popularity of electronic products, electronic products owned by consumers are more and more in types and number. When these electronic products are used, usually information and signal exchange are required between the electronic products. When high frequency signals are exchanged, the industry generally adopts a coaxial cable connector with good shield effect for conduction.

For example, Chinese Patent CN201171125Y discloses a coaxial cable connector widely used in the industry that includes: an insulating body with a mounting hole disposed on the insulating body for receiving a cable docking head to be inserted therein, a fixed terminal, fixed at an end of the insulating body and welded to a circuit board, and a movable terminal, fixed at the other end of the insulating body, where one end of the movable terminal is welded to the circuit board, and the other end of the movable terminal is in electric contact with the fixed terminal. When the cable docking head is inserted into the mounting hole, and is in electric contact with the movable terminal, the movable terminal and the fixed terminal are disconnected. In this case, the circuit board may be conducted to the cable docking head through the coaxial cable connector, and therefore, the circuit board and the cable docking head can exchange high frequency signals. The coaxial cable connector further includes a shielding shell covering the insulating body, so as to shield the movable terminal and the fixed terminal and prevent, at the time of transmitting a high frequency signal, the movable terminal and the fixed terminal from interference of an external signal, which influences high frequency performance of the coaxial cable connector. It can be known from this description that the shield effect of the coaxial cable connector is good.

The current coaxial cable connector is impeccable with respect to the effect of transmitting a high frequency signal, but it still has deficiency which mainly lies in that fast plugging in one step between electronic products cannot be achieved. When a coaxial cable connector is connected to the electronic products to transmit a high frequency signal, two ends of a cable docking head must be respectively docked with the coaxial cable connector on the two electronic products once, that is, be connected twice. Correspondingly, when it is dismantled, it must be disengaged twice. That is, fast plugging in one step between electronic products cannot be achieved. This defect does not seem to be a big deal, however, it is difficult for current picky consumers to accept.

Therefore, a heretofore unaddressed need exists in the art to address the aforementioned deficiencies and inadequacies.

SUMMARY OF THE INVENTION

In one aspect, the present invention provides a high frequency adapter that both has good shield effect and can achieve fast plugging between electronic products.

In one embodiment, a high frequency adapter electrically connecting a docking device to a circuit board according to the present invention includes an insulating body, an RF (Radio Frequency) signal terminal and two grounding terminals. The insulating body is located above the circuit board, and has a first end surface facing the docking device. The RF signal terminal is fixed in the insulating body, and has a first conductive connection portion conductively connected to the circuit board, and a first contact portion extending from the first conductive connection portion and exposed out of the first end surface. The two grounding terminals are fixed in the insulating body and located at two sides of the RF signal terminal. Each of the grounding terminals has a second conductive connection portion conductively connected to the circuit board, and a second contact portion extending from the second conductive connection portion and exposed out of the first end surface. Lateral projections of the RF signal terminal and the two grounding terminals are approximately the same and overlapping. Both the first contact portion and the two second contact portions are pressed by the docking device.

Further, three receiving slots are abreast and concavely disposed on the first end surface of the insulating body. The receiving slots run through the bottom surface of the insulating body downward, and a sidewall of each of the receiving slots is disposed with a blocker located at an upper end of the receiving slot and being close to the first end surface. The RF signal terminal has a first stop portion in a curved shape which is located in the receiving slot and butts against the blocker, and the first stop portion is connected to the first conductive connection portion and the first contact portion. Alternatively, the RF signal terminal has a first stop portion which is located in the receiving slot and butts against the blocker, and the first stop portion is formed by upward extension of the first contact portion. An upper surface of the circuit board is disposed with a coaxial cable connector plugged by a cable docking head, and the high frequency adapter and the coaxial cable connector are conductively connected. The coaxial cable connector includes a main body, a movable terminal and a fixed terminal which are fixed in the main body, and a shielding shell covering the main body. Before the cable docking head is plugged into the coaxial cable connector, the movable terminal and the fixed terminal are conductively connected. When the cable docking head is plugged into the coaxial cable connector and is conductively connected to the movable terminal, the movable terminal and the fixed terminal are disconnected. The RF signal terminal and the movable terminal are conductively connected. The RF signal terminal and the movable terminal are integrally formed. The main body is formed by covering of a first main body on a second main body. A fixing hole is concavely disposed on the first main body for receiving the cable docking head to be inserted therein. The two grounding terminals are conductively connected to the shielding shell, and, together with the shielding shell, conductively connected to the circuit board and grounded. The RF signal terminal transmits an RF signal.

In the embodiments of the present invention, the two grounding terminals are located at the two sides of the RF signal terminal, and the lateral projections of the RF signal terminal and the two grounding terminals are approximately the same and overlapping. That is, the RF signal terminal and the two grounding terminals are coplanar. By means of this structure and then by setting reasonable relevant parameters (such as the distance between the RF signal terminal and the grounding terminal, the sizes of the RF signal terminal and the grounding terminal, and dielectric coefficients of materials of the RF signal terminal and the grounding terminal), a high frequency signal is transmitted with a coplanar waveguide technology, so that the shield effect of the high frequency adapter is good and the high frequency signal may be well transmitted. Further, the high frequency adapter is directly connected to the docking device in a press manner, so that the docking device and the circuit board can achieve fast plugging in one step, and therefore the plugging is convenient and swift.

For convenience of further knowing and understanding the objective, the shape, the construction, the characteristic and the efficacy of the high frequency adapter provided in the present invention, detailed illustration is made with reference to embodiments and accompanying drawings.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
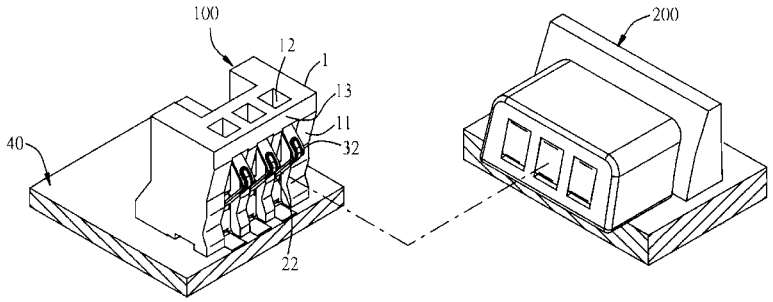
FIG. 1 is a three-dimensional view of a first embodiment of a high frequency adapter according to the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Figure 5:
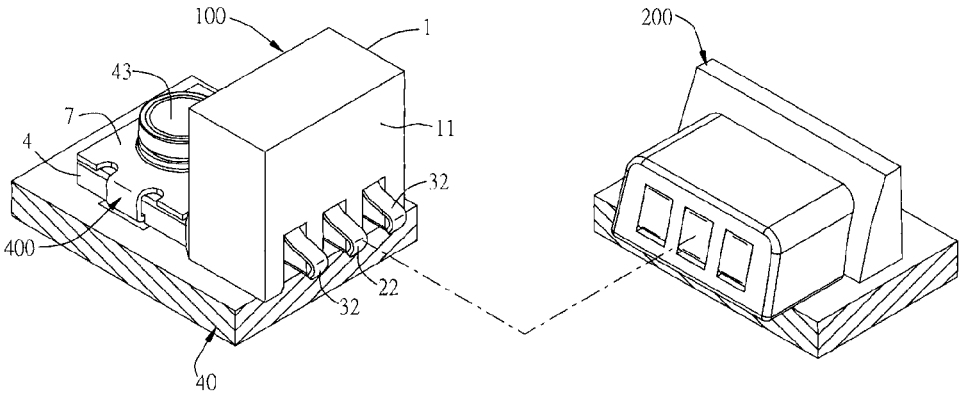
FIG. 5 is a three-dimensional view of a second embodiment of a high frequency adapter according to the present invention.
Figure 6:
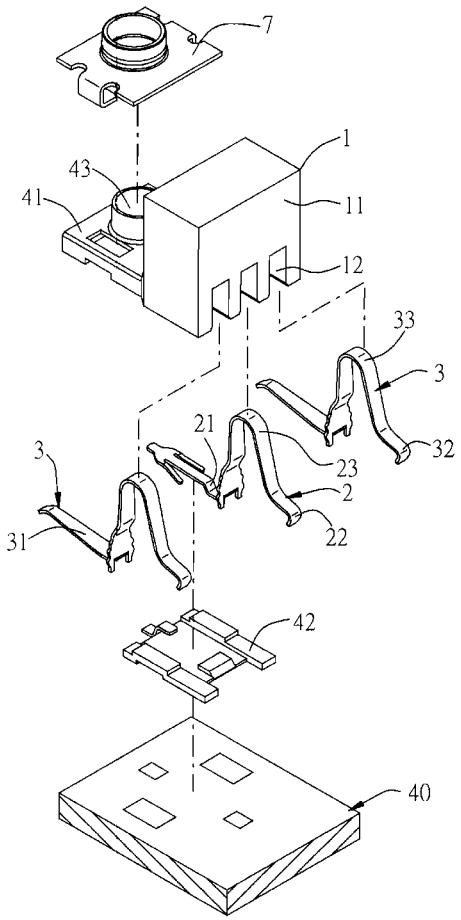
FIG. 6 is a three-dimensional exploded view of a second embodiment of a high frequency adapter according to the present invention.
Figure 7:
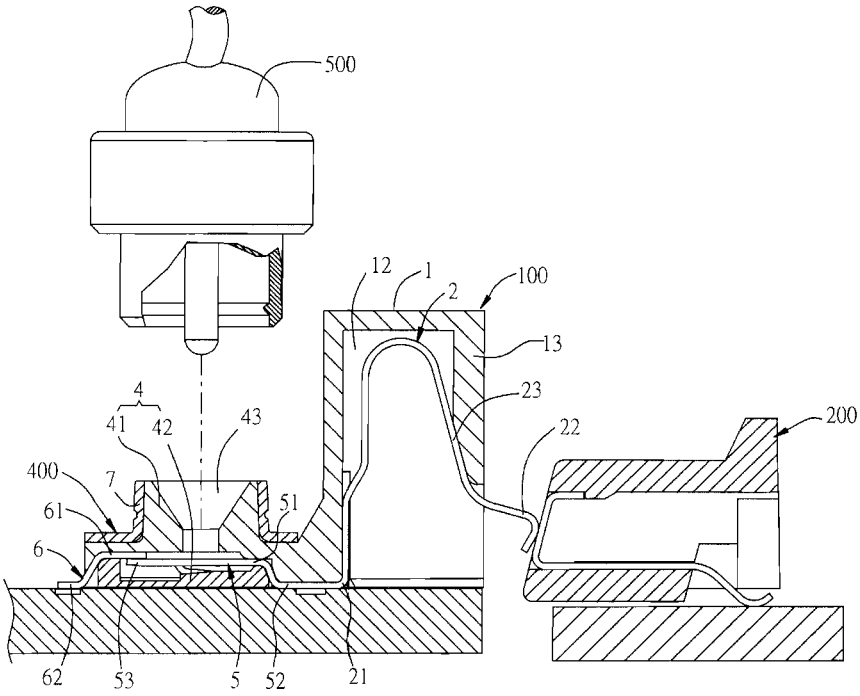
FIG. 7 is a cross-sectional view of a second embodiment of a high frequency adapter before a cable docking head is inserted according to the present invention.
Figure 8:
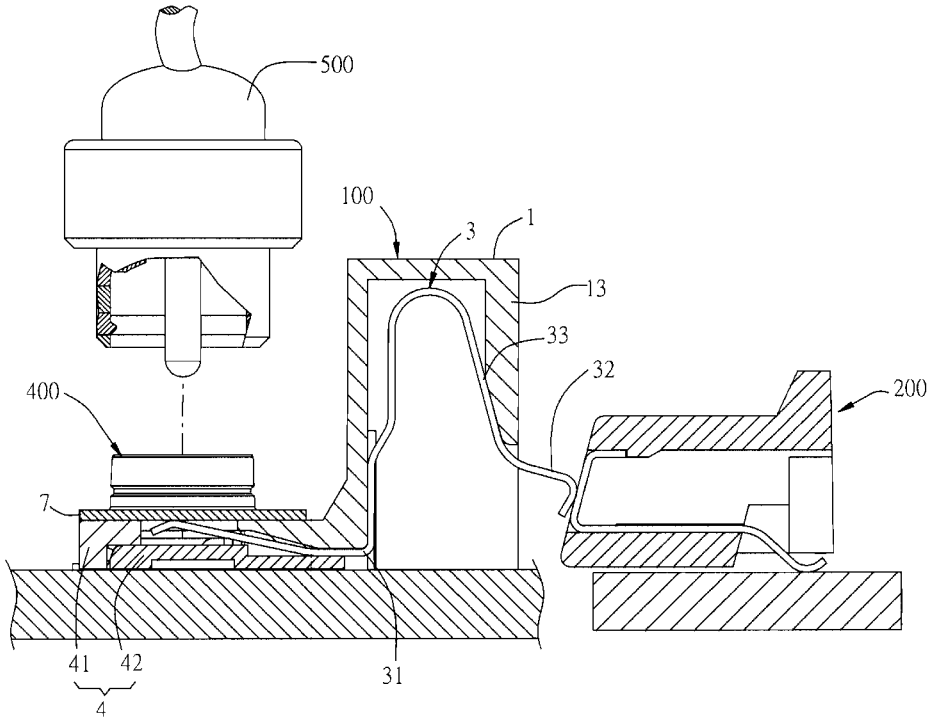
FIG. 8 is a cross-sectional view of another section of a second embodiment of a high frequency adapter before a cable docking head is inserted according to the present invention.

Referring to FIG. 1 and FIG. 5, a high frequency adapter 100 provided in the embodiments of the present invention is mounted to an upper surface of a circuit board 40 and is pressed by a docking device 200, thus the docking device 200 is conductively connected to the circuit board 40. The high frequency adapter 100 adopts a coplanar waveguide technology, and therefore a high frequency signal can be transmitted between the circuit board 40 and the docking device 200. The docking device 200 may be a mobile phone, a notebook computer or another communication apparatus, and the circuit board 40 may also be a motherboard of another mobile phone, notebook computer or communication apparatus. The high frequency adapter 100 may achieve high frequency signal exchange between the circuit board 40 and the docking device 200.

FIGS. 1-4 show a first embodiment of the high frequency adapter 100 according to the present invention.

Figure 2:
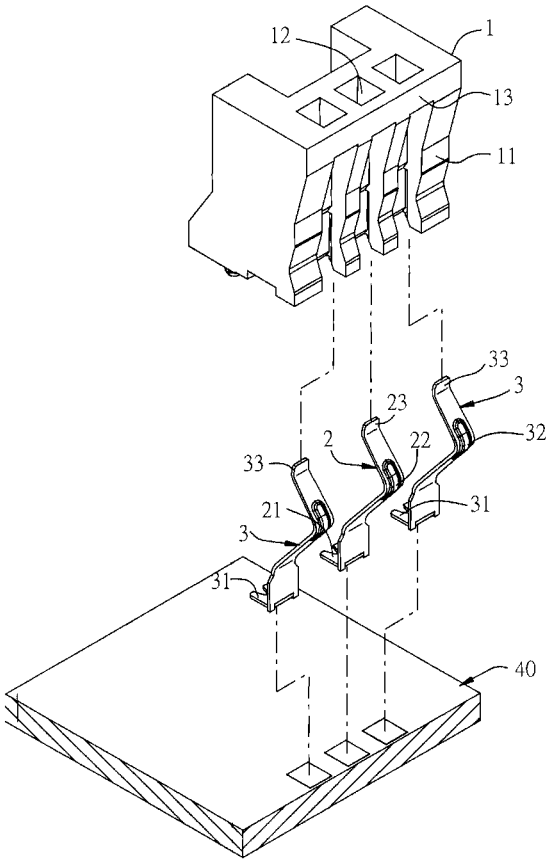
FIG. 2 is a three-dimensional exploded view of a first embodiment of a high frequency adapter according to the present invention.
Figure 3:
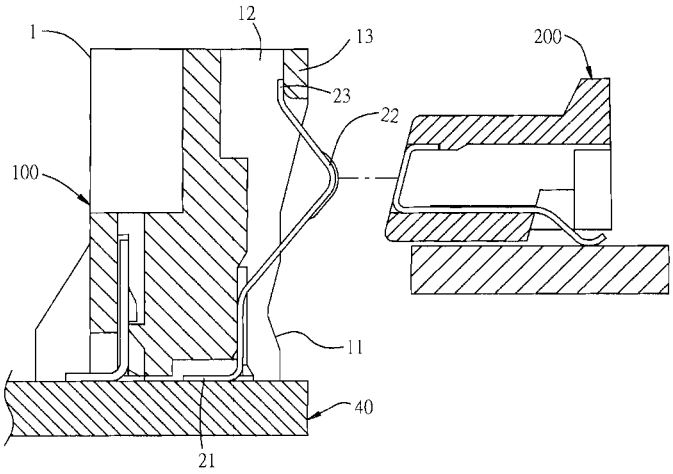
FIG. 3 is a cross-sectional view of a first embodiment of a high frequency adapter before a docking device is pressed according to the present invention.

Referring to FIGS. 1-3, the high frequency adapter 100 includes an insulating body 1 located above the circuit board 40. The insulating body 1 has a first end surface 11 facing the docking device 200. In this embodiment, the first end surface 11 is a lateral end surface of the insulating body 1. Alternatively, in other embodiments, the first end surface 11 may be the top surface of the insulating body 1. Three receiving slots 12 are abreast and concavely disposed on the first end surface 11. Each of the receiving slots 12 runs through the top surface and the bottom surface of the body 1. A sidewall of each receiving slots 12 is disposed with a blocker 13 which is located at an upper end of the receiving slot 12 and close to the first end surface 11. Alternatively, in other embodiments, if the first end surface 11 is the top surface of the insulating body 1, the receiving slots 12 only need to run downwardly through the bottom surface of the insulating body 1.

The high frequency adapter 100 further includes a Radio Frequency (RF) signal terminal 2 used to transmit an RF signal. The RF signal terminal 2 includes a first conductive connection portion 21 which is exposed to the bottom surface of the insulating body 1 and is conductively connected to the circuit board 40, so that the docking device 200 may directly exchange a high frequency signal with the circuit board 40. In this embodiment, referring to FIG. 4, the first conductive connection portion 21 is welded to the circuit board 40. A first contact portion 22 extends upward from the first conductive connection portion 21 and is exposed out of the first end surface 11 to be pressed by the docking device 200. In order to make the conductive connection performance of the RF signal terminal 2 and the docking device 200 better, a convex rib (not labeled) is convexly disposed on the first contact portion 22.

Figure 4:
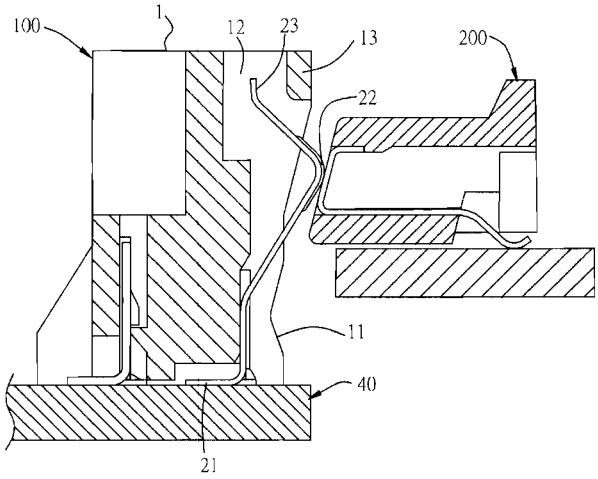
FIG. 4 is a cross-sectional view of a first embodiment of a high frequency adapter when a docking device is pressed according to the present invention.

Referring to FIG. 3 and FIG. 4, further, a first stop portion 23 extends from the first contact portion 22 upward, enters the receiving slot 12 and butts against the blocker 13. The blocker 13 applies certain pre-press to the first stop portion 23, so as to provide a pre-pressure for the RF signal terminal 2. Thus, when the first contact portion 22 and the docking device 200 are pressed, the contact force is large and the contact is more stable. The blocker 13 can also prevent the RF signal terminal 2 from moving out of the receiving slot 12.

Referring to FIGS. 1-3, the high frequency adapter 100 further includes two grounding terminals 3. In this embodiment, the structure of the grounding terminals 3 are basically the same as that of the RF signal terminal 2, so it is convenient for the terminals (the grounding terminals 3 and the RF signal terminal 2) to be produced with the same production technique. Alternatively, in other embodiments, the structure of the grounding terminals 3 may also be different from that of the RF signal terminal 2. The two grounding terminals 3 are located at two sides of the RF signal terminal 2, and the lateral projections of the two grounding terminals 3 and the RF signal terminal 2 are approximately the same and overlapping. If a curved surface is stretched outward from two lateral ends of the RF signal terminal 2, the two grounding terminals 3 and the RF signal terminal 2 are all located on the curved surface, that is, the RF signal terminal 2 and the two grounding terminals 3 are coplanar. By means of this structure and then by setting reasonable relevant parameters (such as the distance between the RF signal terminal 2 and the grounding terminal 3, the sizes of the RF signal terminal 2 and the grounding terminal 3, and dielectric coefficients of materials of the RF signal terminal 2 and the grounding terminal 3), a high frequency signal is transmitted with the coplanar waveguide technology, thereby, when the RF signal terminal 2 transmits a high frequency signal, the high frequency signal is uneasily subject to interference by an external signal, and after being transmitted by the RF signal terminal 2, the high frequency signal attenuates little.

Each of the grounding terminals 3 includes a second conductive connection portion 31 which is exposed to the bottom surface of the insulating body 1, is conductively connected to the circuit board 40 and is grounded. In this embodiment, the second conductive connection portion 31 is directly welded to the circuit board 40. A second contact portion 32 extends upward from the second conductive connection portion 31 and is exposed out of the first end surface 11. Likewise, a convex rib (not labeled) is convexly disposed on the second contact portion 32, so that the conductive connection performance of the second contact portion 32 and the docking device 200 is better. A second stop portion 33 extends upward from the second contact portion 32, enters the receiving slot 12 and butts against the blocker 13. The second contact portion 32 and the first contact portion 22 are commonly pressed by the docking device 200 and therefore fast plugging in one step may be achieved between the circuit board 40 and the docking device 200.

FIGS. 5-9 show a second embodiment of the high frequency adapter 100 according to the present invention. It is different from the previous embodiment in that, the receiving slot 12 only runs through the bottom surface of the insulating body 1, the first stop portion 23 is bended. The first stop portion 23 first extends upward from the first conductive connection portion 21 and then bends and extends downward and therefore forms an inverted "U" shape. The first contact portion 22 is formed by downward extension of the first stop portion 23. That is, the first stop portion 23 is located between the first conductive connection portion 21 and the first contact portion 22 and connects the first conductive connection portion 21 and the first contact portion 22. Likewise, the second stop portion 33 first extends upward from the second conductive connection portion 31 and then bends and extends downward and therefore forms an inverted "U" shape. The second contact portion 32 is formed by downward extension of the second stop portion 33.

The upper surface of the circuit board 40 is disposed with a coaxial cable connector 400 to be inserted by a cable docking head 500, so that a high frequency signal can be transferred between the cable docking head 500 and the circuit board 40. The high frequency adapter 100 is conductively connected to the coaxial cable connector 400 so that high frequency signals may be exchanged between the cable docking head 500 and the docking device 200.

The coaxial cable connector 400 includes a main body 4, and the main body 4 is formed of a first main body 41 and a second main body 42. In this embodiment, the first main body 41 is located above the second main body 42, that is, the main body 4 is formed by top-bottom covering of the first main body 41 and the second main body 42. The first main body 41 and the insulating body 1 may be integrally formed. The first main body 41 is concavely disposed with a fixing hole 43 for receiving the cable docking head 500 to be inserted therein. The coaxial cable connector 400 further includes a movable terminal 5 and a fixed terminal 6, in which a part of the movable terminal 5 is located in the fixing hole 43, so as to be pressed by the cable docking head 500 and be in electric contact with the cable docking head 500. The movable terminal 5 has a first fixing portion 51 which is fixed at an end of the main body 4 and is located between the first main body 41 and the second main body 42. A first welding portion 52 extends downward from the first fixing portion 51, is exposed to the bottom surface of the main body 4 and is welded to the circuit board 40, so that the movable terminal 5 and the circuit board 40 are electrically connected. A first contact segment 53 extends from the first fixing portion 51 to the fixed terminal 6 and is in electric contact with the fixed terminal 6. The fixed terminal 6 has a second fixing portion 61 which is fixed at the other end of the main body 4 and is located between the first main body 41 and the second main body 42. A second welding portion 62 extends downward from the second fixing portion 61, is exposed to the bottom surface of the main body 4 and is welded to the circuit board 40, so that the fixed terminal 6 and the circuit board 40 are electrically connected.

The coaxial cable connector 400 further includes a shielding shell 7. The shielding shell 7 covers the main body 4, is conductively connected to the circuit board 40 and is grounded, so as to shield the movable terminal 5 and the fixed terminal 6 and prevent the movable terminal 5 and the fixed terminal 6, at the time of transferring a high frequency signal, from interference of external electromagnetic wave which influences high frequency performance of the high frequency signal.

In this embodiment, the RF signal terminal 2 and the movable terminal 5 are conductively connected, and the RF signal terminal 2 and the movable terminal 5 are integrally formed. Alternatively, in other embodiments, the RF signal terminal 2 and the movable terminal 5 may also be formed separately. The two grounding terminals 3 are conductively connected to the shielding shell 7, and are, together with the shielding shell 7, conductively connected to the circuit board 40 and grounded. Alternatively, in other embodiments, the RF signal terminal 2 may be conductively connected to the fixed terminal 6, and the shielding shell 7 and the two grounding terminals 3 may respectively be conductively connected to the circuit board 40 and grounded independently.

Before the cable docking head 500 is inserted into the fixing hole 43, the movable terminal 5 and the fixed terminal 6 are conductively connected. It is assumed that the fixed terminal 6 and an internal receiving antenna on the circuit board 40 are conductively connected, and in this case, the circuit board 40 may transfer a high frequency signal received by the internal antenna to the docking device 200. A specific transmission path of the high frequency signal is as follows: the internal antenna transfers the high frequency signal to the fixed terminal 6, and then the high frequency signal is transferred to the movable terminal 5 through the fixed terminal 6. While a part of the high frequency signal on the movable terminal 5 is transferred to the circuit board 40 through the first welding portion 52, the other part is transferred to the docking device 200 through the RF signal terminal 2.

Figure 9:
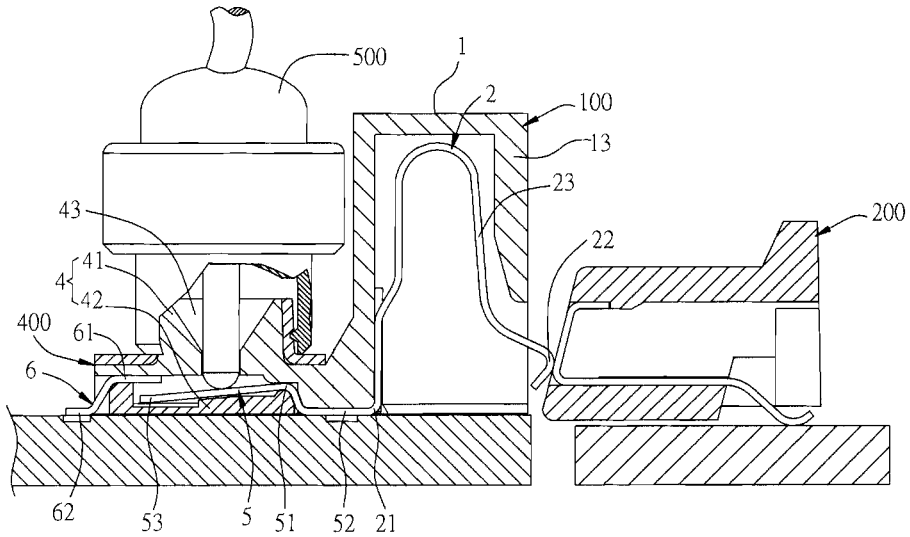
FIG. 9 is a cross-sectional view of a second embodiment of a high frequency adapter when a cable docking head is inserted according to the present invention.

Referring to FIG. 9, when the cable docking head 500 is inserted into the fixing hole 43, and is in a press contact with the movable terminal 5, the movable terminal 5 and the fixed terminal 6 are disconnected, and the cable docking head 500 may exchange high frequency signals with the docking device 200. It is assumed that the cable docking head 500 is a receiving antenna, a high frequency signal is transferred to the docking device 200 by the cable docking head 500, and a specific transmission path of the high frequency signal is as follows: the cable docking head 500 first transfers the high frequency signal to the movable terminal 5, then a part of the high frequency signal passing through the movable terminal 5 is transferred to the circuit board 40 through the first welding portion 52, and the other part is transferred to the RF signal terminal 2, and further, transferred to the docking device 200 through the RF signal terminal 2.

Only that the docking device 200 receiving a high frequency signal is taken as examples above, but the present invention is not limited to this. The docking device 200 may also send a high frequency signal to the circuit board 40, that is, the docking device 200 and the circuit board 40 may mutually exchange high frequency signals.

Figure 10:
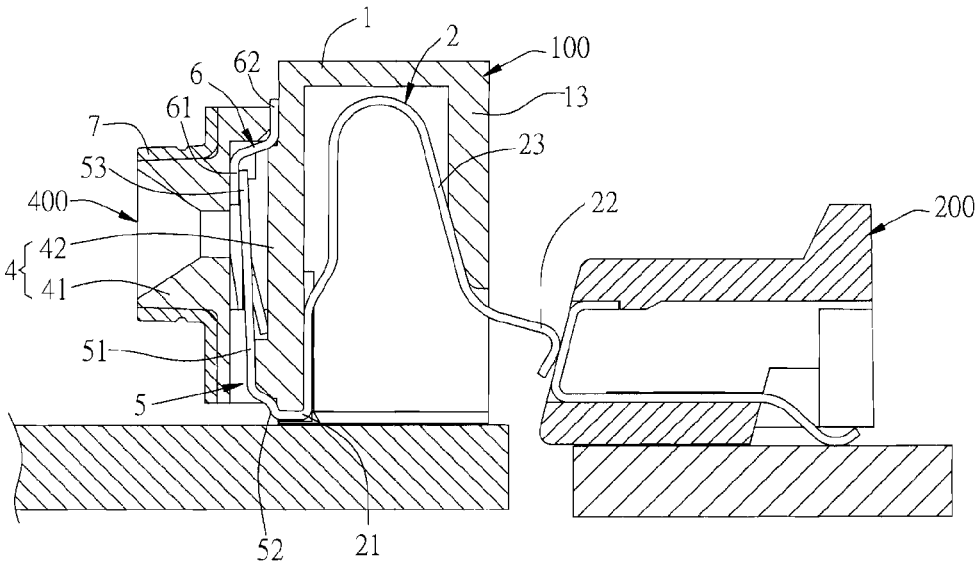
FIG. 10 is a cross-sectional view of a third embodiment of a high frequency adapter according to the present invention.

FIG. 10 shows a third embodiment of the high frequency adapter according to the present invention, which is different from the second embodiment manner in that: the coaxial cable connector 400 may rotate 90 degrees counter-clockwise relative to the coaxial cable connector 400 in the previous embodiment. In this case, the first main body 41 is located at the left side of the second main body 42, that is, the main body 4 is formed by left-right covering of the first main body 41 and the second main body 42. The insulating body 1 and the second main body 42 are integrally formed, and the movable terminal 5 is conductively connected to the circuit board 40 and the RF signal terminal 2. In this embodiment, the first welding portion 52 of the movable terminal 5 and the circuit board 40 are conductively connected, such as welded.

Before the cable docking head 500 is inserted into the fixing hole 43, a high frequency signal may be directly transferred between the docking device 200 and the circuit board 40 through the first welding portion 52, and therefore the path for transmitting the high frequency signal between the circuit board 40 and the docking device 200 is short, and the signal attenuation is also little.

When the cable docking head 500 is inserted into the fixing hole 43, and is in press contact with the movable terminal 5, the movable terminal 5 and the fixed terminal 6 are disconnected, and the cable docking head 500 and the docking device 200 may exchange high frequency signals. It is assumed that the cable docking head 500 is a receiving antenna, a high frequency signal is transferred to the docking device 200 by the cable docking head 500, and a specific transmission path of the high frequency signal is as follows: the cable docking head 500 first transfers the received high frequency signal to the movable terminal 5, then a part of the high frequency signal passing through the movable terminal 5 is transferred to the circuit board 40 through the first welding portion 52, and the other part is transferred to the RF signal terminal 2, and further, transferred to the docking device 200 through the RF signal terminal 2.

To sum up, the high frequency adapter 100 of the present invention, among other things, has the following beneficial effects.

1. In the embodiments of the present invention, the two grounding terminals 3 are located at two sides of the RF signal terminal 2, and lateral projections of the RF signal terminal 2 and the two grounding terminals 3 are approximately the same and overlapping, that is, the RF signal terminal 2 and the two grounding terminals 3 are coplanar. By means of this structure and then by setting reasonable relevant parameters (such as the distance between the RF signal terminal 2 and the grounding terminal 3, the sizes of the RF signal terminal 2 and the grounding terminal 3, and dielectric coefficients of materials of the RF signal terminal 2 and the grounding terminal 3), a high frequency signal is transmitted with the coplanar waveguide technology, so that the shield effect of the high frequency adapter 100 is good and the high frequency signal may be well conducted.

2. The high frequency adapter 100 is directly connected to the docking device 200 in a press manner so that the docking device 200 and the circuit board 40 can achieve fast plugging in one step and therefore the plugging is convenient and swift.

3. The high frequency adapter 100 may be conductively connected to the coaxial cable connector 400, and further, may directly exchange high frequency signals with the cable docking head 500 through the coaxial cable connector 400, and when the cable docking head 500 is a receiving antenna, the docking device 200 may receive a high frequency signal by direct using the cable docking head 500 and perform corresponding work, such as network surfing.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A high frequency adapter, electrically connecting a docking device to a circuit board, comprising:

an insulating body, located above the circuit board, wherein the insulating body has a first end surface facing the docking device;

a radio frequency (RF) signal terminal, fixed in the insulating body, wherein the RF signal terminal has a first conductive connection portion conductively connected to the circuit board, and a first contact portion extending from the first conductive connection portion is exposed out of the first end surface;

two grounding terminals, fixed in the insulating body and located at two sides of the RF signal terminal, wherein each of the grounding terminals has a second conductive connection portion conductively connected to the circuit board, and a second contact portion extending from the second conductive connection portion is exposed out of the first end surface, wherein lateral projections of the RF signal terminal and the two grounding terminals are approximately the same and overlapping, and the first contact portion and two second contact portions are commonly pressed by the docking device;

wherein an upper surface of the circuit board is disposed with a coaxial cable connector plugged by a cable docking head, and the high frequency adapter is conductively connected to the coaxial cable connector; and wherein the coaxial cable connector comprises a main body, a movable terminal and a fixed terminal fixed in the main body, and a shielding shell covering the main body, wherein before the cable docking head is plugged into the coaxial cable connector, the movable terminal and the fixed terminal are conductively connected, and when the cable docking head is plugged into the coaxial cable connector and is conductively connected to the movable terminal, the movable terminal and the fixed terminal are disconnected.

2. The high frequency adapter according to claim 1, wherein three receiving slots are abreast and concavely disposed on the first end surface, each of the receiving slots runs through a bottom surface of the insulating body downward, and a sidewall of each of the receiving slots is disposed with a blocker which is located at an upper end of the receiving slot and is close to the first end surface.

3. The high frequency adapter according to claim 2, wherein the RF signal terminal has a first stop portion in a curved shape which is located in the receiving slot and butts against the blocker, and the first stop portion is connected to the first conductive connection portion and the first contact portion.

4. The high frequency adapter according to claim 2, wherein the RF signal terminal has a first stop portion which is located in the receiving slot and butts against the blocker, and the first stop portion is formed by upward extension of the first contact portion.

5. The high frequency adapter according to claim 1, wherein the RF signal terminal is conductively connected to the movable terminal.

6. The high frequency adapter according to claim 1, wherein the RF signal terminal and the movable terminal are integrally formed.

7. The high frequency adapter according to claim 1, wherein the main body is formed by covering of a first main body and a second main body, and a fixing hole is concavely disposed on the first main body for receiving the cable docking head to be inserted therein.

8. The high frequency adapter according to claim 1, wherein the two grounding terminals are conductively connected to the shielding shell, and, together with the shielding shell, are conductively connected to the circuit board and are grounded.

9. The high frequency adapter according to claim 1, wherein the RF signal terminal transmits an RF signal.

* * * * *